US005641201A

United States Patent [19]

Casey et al.

[11] Patent Number: 5,641,201

[45] Date of Patent: Jun. 24, 1997

[54] UNIVERSAL LIFT FRAME FOR A CHAIR

[75] Inventors: Kenneth Casey, Plymouth; Kenneth A. Kemmerer, Wilkes-Barre, both of Pa.

[73] Assignee: American Dream International, Kingston, Pa.

[21] Appl. No.: 329,763

[22] Filed: Oct. 27, 1994

Related U.S. Application Data

[63] Continuation of Ser. No. 24,754, Mar. 2, 1993, abandoned.

[51] Int. Cl.[6] ..... A61G 15/04

[52] U.S. Cl. ..... 297/326; 297/440.22; 297/DIG. 10

[58] Field of Search ..... 297/DIG. 10, 326, 297/325, 440.22; 414/917; 254/3 R, 124

[56] References Cited

U.S. PATENT DOCUMENTS

| | | | |
|---|---|---|---|
| 1,455,727 | 5/1923 | Hill | 414/917 |
| 2,317,515 | 4/1943 | Booth | 297/440.22 |
| 2,513,440 | 7/1950 | Alderson | 214/65 |
| 2,853,119 | 9/1958 | Balfour | 297/130 |
| 2,928,558 | 3/1960 | Bamford et al. | 214/1 |
| 3,059,904 | 10/1962 | Kimball | 254/10 |
| 3,138,402 | 6/1964 | Heyl | 297/DIG. 10 |
| 3,222,032 | 12/1965 | Schneider | 254/124 |
| 3,250,569 | 5/1966 | Gaffney | 297/330 |
| 3,476,404 | 11/1969 | Rachman | 280/30 |
| 3,825,302 | 7/1974 | Kurtz | 297/440.22 |
| 3,888,463 | 6/1975 | O'Brien et al. | 254/10 C |
| 4,007,960 | 2/1977 | Gaffney | 297/71 |
| 4,083,599 | 4/1978 | Gaffney | 297/131 |
| 4,158,524 | 6/1979 | Serafin | 414/678 |
| 4,592,695 | 6/1986 | McConnell | 414/678 |
| 4,725,188 | 2/1988 | Zimmermann et al. | 414/678 |
| 4,772,164 | 9/1988 | McFarland | 410/3 |
| 4,786,107 | 11/1988 | Crockett | 297/330 |
| 4,850,645 | 7/1989 | Crockett | 297/DIG. 10 |
| 4,852,939 | 8/1989 | Krauska | 297/71 |
| 4,899,985 | 2/1990 | Good | 254/124 |
| 4,946,222 | 8/1990 | Matson | 297/325 |
| 4,993,777 | 2/1991 | LaPointe | 297/325 |

FOREIGN PATENT DOCUMENTS

| | | | |
|---|---|---|---|
| 0077280 | 4/1983 | European Pat. Off. | 297/DIG. 10 |
| 2716821 | 11/1977 | Germany | 297/DIG. 10 |
| 939458 | 10/1963 | United Kingdom | 297/440.22 |

*Primary Examiner*—Peter M. Cuomo
*Assistant Examiner*—David E. Allred
*Attorney, Agent, or Firm*—Nies, Kurz, Bergert & Tamburro

[57] ABSTRACT

A universal lift frame to which the bottom of a conventional chair, recliner or lounger is readily attachable. The frame includes a base and a platform which is moved vertically and tilted forward and backward to assist the occupant in getting in and out of the chair.

23 Claims, 4 Drawing Sheets

UNIVERSAL LIFT FRAME FOR A CHAIR

This application is a continuation of application Ser. No. 08/024,754, filed Mar. 2, 1993, now abandoned.

BACKGROUND OF THE INVENTION

This invention relates generally to lifting devices for use with seating apparatus and, more particularly, to a novel universal lifting and tilting frame to which the bottom of a conventional chair, recliner or lounger is readily attachable so as to provide that conventional chair with a lifting and tilting feature.

In the past chairs of various types have been provided with mechanisms by which the seat of the chair and its occupant may be slightly raised and lowered and tilted forward and back to assist the occupant, for example an elderly or handicapped person in getting in and out of the chair. Those mechanisms have traditionally formed an integral part of the chair construction as exemplified by the units illustrated in U.S. Pat. Nos. 4,007,960, 4,083,599, and 4,852,939. Those chair assemblies are costly and thus are quite often unavailable to persons who need the lift and tilt feature the most.

There is a need in the marketplace for a separate lift frame assembly which can be readily attached to the understructure of a conventional chair, recliner or lounger that would enable a person to provide his favorite chair with a lift and tilt capacity. The frame assembly must be attachable in quick and easy fashion and must be available at a cost which is significantly less than the cost of a new chair having a totally integrated lift and tilt mechanism. Others have proposed separate and independent elevator and lift mechanisms for use with chairs of various types and typical of those prior proposals are the devices illustrated in U.S. Pat. Nos. 3,888,463, 4,772,164, 4,786,107 and 4,850,645. However none of these proposals has satisfied the specific demand of the marketplace and a need remains for a universal lift frame of simple construction which is readily adaptable for use with a wide variety of chairs and may be manufactured and marketed at a very reasonable cost.

SUMMARY OF THE INVENTION

Accordingly the primary object of this invention resides in the provision of a novel, universal lift frame to which the bottom of a conventional chair is readily attachable so that the chair may be tilted forward and backward to assist the occupant such as an invalid or handicapped person in getting in and out of the chair.

A further object of the invention resides in the provision of the above novel universal lift frame which may be manufactured as a separate independent structure and then may be quickly and easily attached to the bottom of a wide variety of conventional chairs to provide a lift and tilt feature to those chairs.

Still another object of the invention resides in the provision of the above novel, universal lift frame which is of simple economical construction but yet is sturdy enough to provide a safe stable support for any chair mounted thereon.

A further object of the invention resides in the provision of the above novel universal lift frame having a base which rests on a floor and a tilting platform having a mounting plate to which the understructure of a conventional chair may be readily attached so that the chair is supported on the plate. A reversible power mechanism is connected directly between the base and the platform so that the chair may be raised and lowered in a tilting fashion under the control of the occupant.

Other objects of the invention will become apparent from reading the following detailed description of the invention in which reference is made to the accompanying drawings.

DETAILED DESCRIPTION OF THE INVENTION

Figure 1:
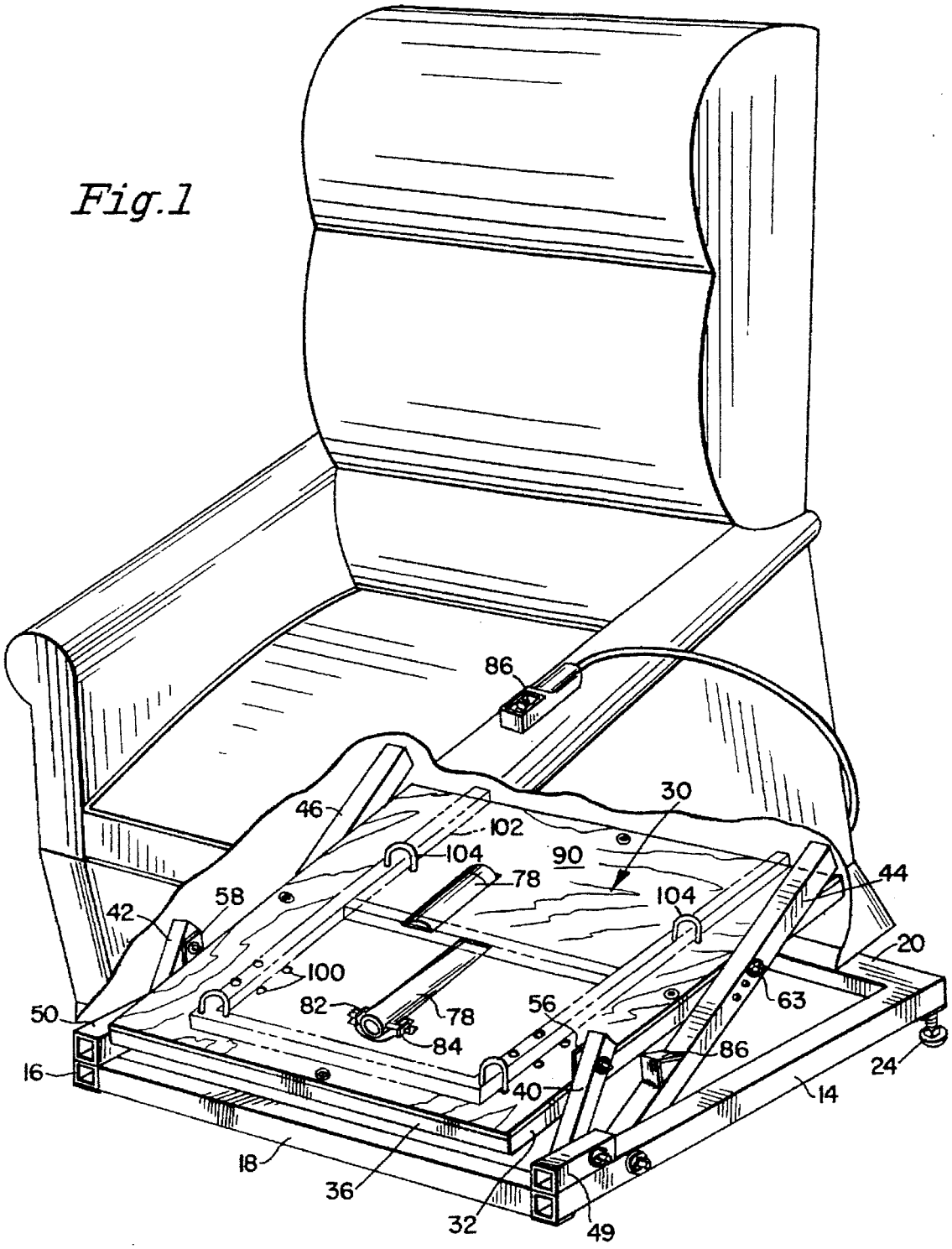
FIG. 1 is a generally perspective view illustrating a conventional chair mounted on the novel universal lift frame of the invention.

As shown in FIG. 1 a chair of conventional construction may be readily and easily mounted on the universal lift frame assembly 10 of the invention and secured thereto so as to be raised and lowered in tilting fashion toward and away from the front to assist its occupant in getting out of and into the seat. The chair may be of any conventional type such as a straight back chair, a recliner, or a lounger.

The lift frame assembly 10 includes a generally horizontal, rectangular base 12 formed by a pair of laterally spaced longitudinally extending metallic square tubular side pieces 14 and 16 which are welded together with laterally extending metallic square tubular front and rear gross pieces 18 and 20 respectively. A rubber pad 22 is provided at the front of each of pieces 14 and 16 and a levelling screw 24 is provided at the rear of each of pieces 14 and 16 so that the base 12 can be levelled horizontally on any floor.

A support and lift platform 30 is mounted on base 12 and is movable vertically with respect to base 12. Platform 30 includes a rectangular frame formed by longitudinally extending metallic square tubular side pieces 32 and 34 welded together with a front laterally extending metallic tubular member 36 and a rear laterally extending metallic angle iron member 38.

Figure 4:
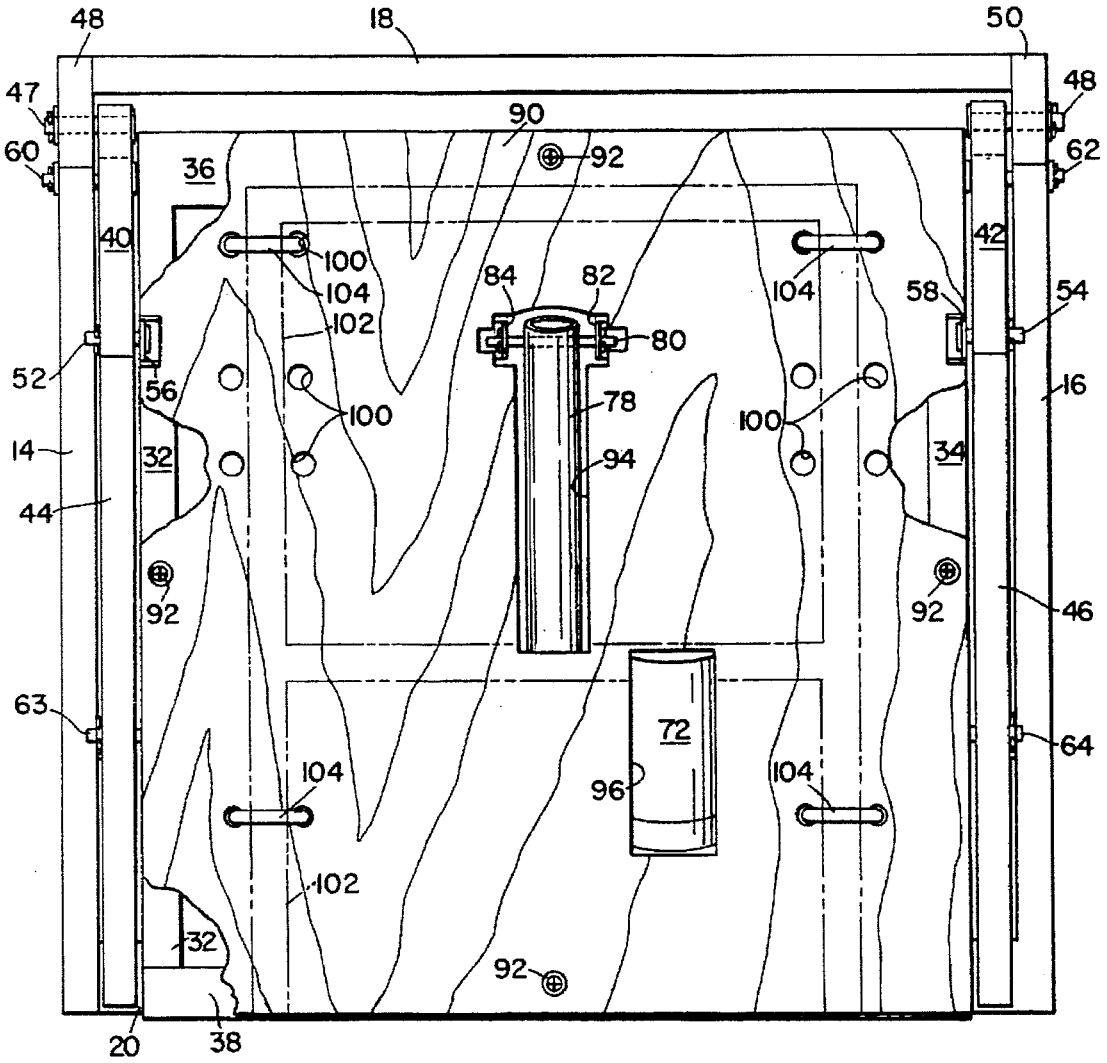
FIG. 4 is a top plan view of the universal lift frame of the invention taken along line 4—4 of FIG. 2.
Figure 5:
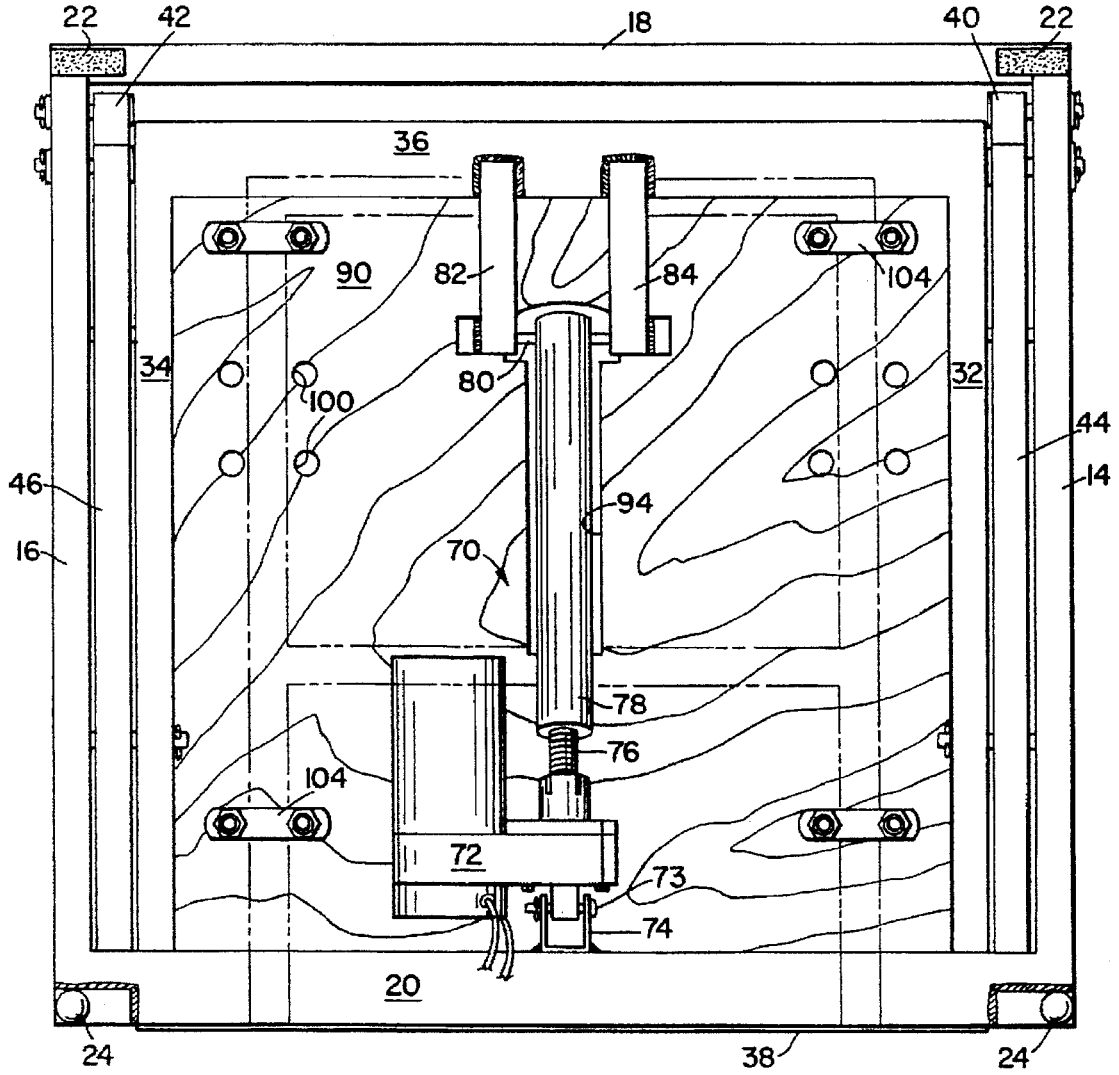
FIG. 5 is a bottom plan view taken along line 5—5 of FIG. 2.

As shown in FIGS. 1, 4 and 5, the lateral width between the outside faces of tubular pieces 32 and 34 is substantially less than the width between the inside faces of pieces 14 and 16 of base 12 so that platform 30 fits laterally within the confines of base 12.

Platform 30 is movably mounted with respect to base 12 by way of a pair of short front lever arms 40 and 42 and longer rear lever arms 44 and 46 located within the vertical spaces defined between the side faces of tubular pieces 14 and 32, and 16 and 34, with the front arms 40 nd 42 vertically overlying the front portions of arms 44 and 46. The front ends of arms 40 and 42 are pivotally connected via pins 47 and 48 to tubular brackets 49 and 50, respectively, which are welded onto the top of the front ends of side pieces 14 and 16. The rear ends of arms 40 and 42 are pivotally connected via pins 52 and 54 to angle brackets 56 and 58 which are welded to side pieces 32 and 34 respectively at locations spaced rearwardly from the front edge of front cross piece 36 of platform 30.

Figure 3:
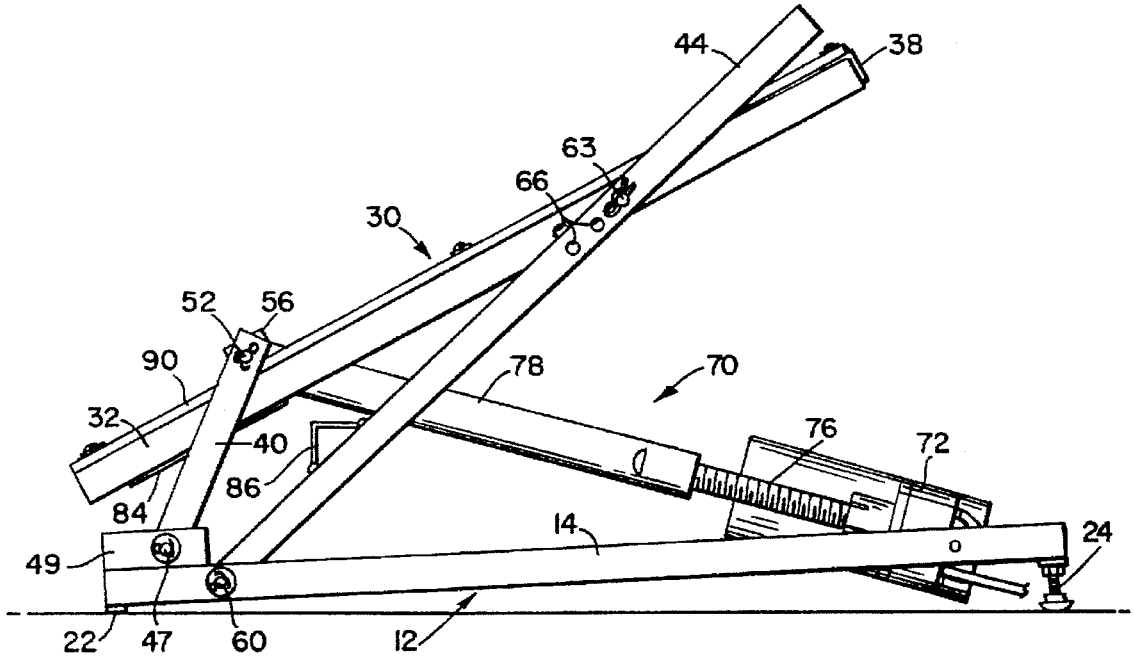
FIG. 3 is a side elevational view similar to FIG. 2 but with the platform in a raised forwardly tilting position.

The longer rear lever arms 44 and 46 lie vertically underneath arms 40 and 42 and have their front ends pivotally connected via pins 60 and 62 to side pieces 14 and 16, respectively, of base 12. The rear portions of levers 44 and 46 are connected by pivot pins 63 and 64 to rear portions of pieces 32 and 34. As shown in FIGS. 3 and 4, pieces 32 and 34 and arms 44 and 46 may be provided with a series of drilled holes 66, certain ones of which may be aligned to receive pivot pins 63 and 64 to selectively vary the effective length of lever arms 44 and 46 and thereby vary the height at which the rear portion of platform 30 is raised. In practice as the effective length of lever arms 44 and 46 is increased the rear portion of platform 30 will be raised to a greater height.

A self-contained compact power mechanism 70 is provided to raise and lower platform 30 with respect to base 12. Mechanism 70 includes a conventional small reversible motor-gearbox unit 72, such as a Hubbell model No. MC42-1002, which is pivotally connected at its rear end by pivot pin 73 to a bracket assembly 74 which is welded to the inside face of the rear cross member 20 of base 12. Extending forwardly from the gearbox portion of unit 72 at the centerline of platform 30 is a worm screw 76 and a lift tube 78 which threads forwardly and rearwardly on screw 76 as the motor and screw are rotated in one direction or the other. The forward end of tube 78 is pivotally connected via pivot pin 80 to laterally spaced bracket arms 82 and 84 which are welded to the underside of front cross piece 36 of platform 30. Motor unit 72 is suitably powered by household current and is controlled by a conventional hand operated switch 86 which is conveniently positioned for operation by the occupant of the chair. It should be particularly noted that pivot pins 52, 54 and 80 are preferably aligned on the same transverse pivot axis to facilitate the raising and lowering of platform 30 with respect to base 12.

All the structural components of base 12, platform 30 and power mechanism 70 are selected and arranged to provide a lightweight compact device capable of being collapsed or lowered into a substantially horizontal rest position (FIG. 2) in which it adds very little additional height to the normal height of the chair with which it is to be used. It should be noted that in the rest position of FIG. 2, it is desirable that the lift tube 78 and screw 76 be retained in a slightly upwardly inclined position from back to front so that when the motor unit 72 is initially energized to raise the chair, tube 78 imparts a vertical force component to pin 80 sufficient to start upward movement of platform 30. To ensure that screw 76 and tube 78 are retained in this inclined position, a pair of inverted angle iron stops 86 and 88 are welded on the top face of lever arms 44 and 46 so as to engage against the underside of lever arms 40 and 42 at points generally underlying pivot pins 52 and 54. Consequently under the weight of the chair and its occupant, the rearmost portions of frame members 32, 34 and 38 rest upon base member 20 and lever arms 40 and 42 rest on stops 86 and 88, thereby preventing screw 76 and lift tube 78 from being forced downwardly below a horizontal centerline which would inhibit proper operation of the lift device when the chair was to be raised again.

A flat rectangular mounting plate 90 made of plywood or lightweight aluminum is fastened on top of frame pieces 32, 34, 36 and 38 via screws 92 to provide a flat support surface for the legs or other undersupport of the chair to be placed thereon. Plate 90 is provided with suitable cutouts 94 and 96 if necessary to accommodate for the size and general arrangement of the various components of the power mechanism 70, for example, the lift tube 78 and motor reducer unit 72. Also during the manufacturing process, plate 90 may be provided with various patterns or arrangements of openings 100 corresponding to the understructure support assemblies for the most popular chairs, recliners or loungers on the marketplace. As shown schematically in FIGS. 1, 4 and 5, the chair mounted on plate 90 may have an understructure 102 shown in phantom which is retained on plate 90 by a number of U-shaped bracket assemblies 104 passing over understructure 102 and down through suitable holes in the plate to be bolted against the bottom of the plate 90 as shown in FIG. 5. Because plate 90 is preferably constructed of plywood or aluminum, if necessary the purchaser of the lift frame may drill whatever special hold pattern is required on the plate to accommodate the understructure of his own particular chair. In addition various type fasteners, such as J-bolts, straps and other screw assemblies, can be used to attach the chair to the platform.

Frame 10 is of very stable and sturdy construction. To enhance the stability, close fitting bushings or bearings may be provided between the various pivot pins and associated frame members. In addition the levelling screws 24 enable the base to be solidly supported on any uneven surface. As a result, the frame provides a safe support for a chair and its occupant.

Figure 2:
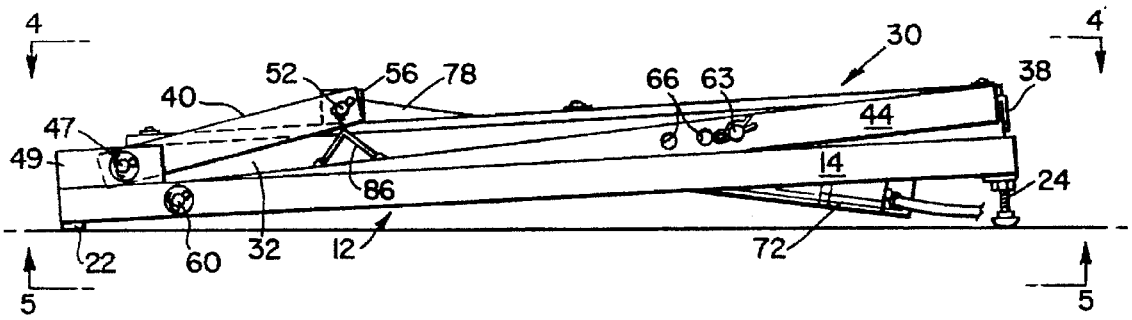
FIG. 2 is a side elevation view of the universal lift frame of the invention shown in its lowermost generally horizontal rest position.

In operation, once the chair has been fastened onto the plate 90, the chair may be easily raised and lowered under control of the switch assembly 86 to assist an occupant in getting into and out of the chair. To raise the chair from its normal horizontal seating position with the frame 10 positioned as shown in FIG. 2, switch 86 is actuated to rotate the motor gear box unit 72 and screw 76 in a direction suitable to extend the lift tube 78 forwardly. As this happens platform 30 is lifted vertically by the pivoting of lever arms 40, 42, 44 and 46 (FIG. 3). Because arms 44 and 46 are longer than arms 40 and 42 the rear portion of platform 90 is raised higher than the front portion so that the frame 30 and the chair is tilted forwardly as lift tube 78 threads outwardly on screw 76. Suitable adjustable stops may be provided within the motor gearbox unit 72 and/or in the screw 76 and lift tube arrangement 78 so as to limit the amount of vertical and tilting movement of frame assembly 30 between the generally horizontal rest position of FIG. 2 and the raised tilting position of FIG. 3.

To again lower the chair and platform 30 from the raised position of FIG. 3 to the rest position of FIG. 2 the reversing button of switch 86 is actuated to reverse the direction of rotation of the motor gearbox unit 72 and screw 76 and thereby retract the lift tube 78 on screw 76 until the rear portions of members 32, 34 and 38 come to rest on rear member 20 and arms 40 and 42 rest upon stop members 86 and 88.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. Lifting apparatus which is adapted to be readily attachable under a separate independent chair which may be normally independently supported on a floor, said apparatus comprising a generally horizontal rectangular base having a pair of laterally spaced side members and front and rear cross members extending between and connected to said side members, generally horizontal platform means having a width less than the lateral spacing between said side members and adapted to support a chair attached thereto, first connecting means pivotally connecting said platform means to said side members to permit said platform means to move with respect to said base vertically from a generally horizontal rest position to a forwardly tilting raised position, said platform means having a portion thereof engaging said base when in said rest position so that said base and said platform means are vertically compact and are adapted to add very little additional height to a chair attached thereto, reversible power means having a longitudinally extensible actuating means having a forward end, second connecting means pivotally connecting said power means to said rear cross member, third connecting means pivotally connecting the forward end of said actuating means to said platform means, said platform means having side surfaces spaced inwardly from said side members and defining lateral spaces therewith, said first connecting means comprising front lever means having a front end pivotally connected to a front portion of said base and a rear end pivotally connected to a front portion of said platform means, rear lever means having a front end pivotally connected to said base adjacent said front lever means and a rear end pivotally connected to a rearward portion of said platform means, said front lever means being shorter than said rear lever means, said front lever means and said rear lever means being located in the lateral spaces between said side members and said side surfaces, and the rear end of said front lever means vertically overlying the front end of said rear lever means whereby energization of said power means causes said actuating means to raise or lower said platform means and a chair attached thereto as desired.

2. Lifting apparatus as defined in claim 1 comprising stop means for maintaining said actuating means in a slightly upwardly forwardly inclined position when said platform means is in said rest position.

3. Lifting apparatus as defined in claim 2, said stop means being mounted on the front end of said rear lever means for abutting a lower surface of said front lever means.

4. Lifting apparatus as defined in claim 1, comprising stop means for maintaining said actuating means in a slightly upwardly forwardly inclined position when said platform means is in said rest position.

5. Lifting apparatus as defined in claim 1, comprising means for attaching a chair to said platform means.

6. Lifting apparatus as defined in claim 5, wherein said attaching means is adjustable to accommodate chairs of different constructions.

7. Lifting apparatus as defined in claim 1, wherein the pivotal connection of the front end of the rear lever means to the base is rearwardly spaced from the pivotal connection of the front end of the front lever means to the base.

8. Lifting apparatus as defined in claim 7, comprising stop means for maintaining said actuating means in a slightly upwardly forwardly inclined position when said platform means is in said rest position.

9. Lifting apparatus as defined in claim 8, said stop means being mounted on the front end of said rear lever means and engaging underneath said front lever means.

10. Lifting apparatus as defined in claim 1, said platform means including a flat mounting plate having a plurality of openings which enable various type seating structures to be mounted on said platform.

11. Lifting apparatus which is adapted to be readily attachable under a separate independent chair which may be normally independently supported on a floor, said apparatus comprising a generally horizontal rectangular base having a pair of laterally spaced side members and front and rear cross members extending between and connected to said side members, generally horizontal platform means adapted to support a chair attached thereto and having side surfaces spaced inwardly from said side members and defining lateral spaces therewith, a lever assembly pivotally connecting said platform means to said base to permit said platform means to move with respect to said base vertically from a generally horizontal rest position to a forwardly tilting raised position, said lever assembly comprising front lever means having a front end pivotally connected to a front portion of said base and a rear end pivotally connected to a front portion of said platform means, rear lever means having a front end pivotally connected to said base adjacent said front lever means and a rear end pivotally connected to a rearward portion of said platform means, said front lever means being shorter than said rear lever means, said front and rear lever means being located in the lateral spaces between said side members and said side surfaces, the rear end of said front lever means vertically overlying the front end of said rear lever means, said platform means having a portion thereof engaging said base when in said rest position so that said base and said platform means are vertically compact and are adapted to add very little additional height to a chair attached thereto, reversible power means having a longitudinally extensible actuating means having a forward end, first pivotal means pivotally connecting said power means to said rear cross member, second pivotal means pivotally connecting the forward end of said actuating means to said platform means, whereby energization of said power means causes said actuating means to raise or lower said platform means and a chair attached thereto as desired, and stop means mounted on the front end of said rear lever means and engagable underneath said front lever means to maintain said actuating means in a slightly upwardly forwardly inclined position when said platform means is in said rest position.

12. Lifting apparatus as defined in claim 11, comprising means for attaching a chair to said platform means.

13. Lifting apparatus as defined in claim 12, wherein said attaching means is adjustable to accommodate chairs of different constructions.

14. Lifting apparatus as defined in claim 11, comprising means for adjusting the length of said rear lever means.

15. Lifting apparatus as defined in claim 11, wherein the pivotal connection of the front end of the rear lever means to the base is rearwardly spaced from the pivotal connection of the front end of the front lever means to the base.

16. Lifting apparatus as defined in claim 11, said platform means including a flat mounting plate having a plurality of openings which enable various types of chairs to be mounted on said platform means.

17. Lifting apparatus which is adapted to be readily attachable under a chair which may be normally independently supported on a floor, said apparatus comprising a generally horizontal rectangular base having a pair of laterally spaced side members and front and rear cross members extending between and connected to said side members, generally horizontal platform means adapted to support a chair attached thereto, first connecting means pivotally connecting said platform means to said side members to permit said platform means to move with respect to said base vertically from a generally horizontal rest position to a forwardly tilting raised position, said first connecting means comprising front lever means having a front end pivotally connected to a front portion of said base and a rear end pivotally connected to and terminating adjacent a front portion of said platform means, rear lever means having a front end pivotally connected to said base adjacent said front lever means and a rear end pivotally connected to a rearward portion of said platform means, said front lever means being shorter than said rear lever means, and the rear end of said front lever means vertically overlying the front end of said rear lever means, and wherein the pivotal connection of the front end of the rear lever means to the base is rearwardly spaced from the pivotal connection of the front end of the front lever means to the base, said platform means having a portion thereof engaging said base when in said rest position so that said base, said platform means, and said front and rear lever means are vertically compact and are adapted to add very little additional height to a chair attached thereto, reversible power means having a longitudinally extensible actuating means having a forward end, second connecting means pivotally connecting said power means to said rear cross member, third connecting means pivotally connecting the forward end of said actuating means to said platform means, said actuating means being maintained in a slightly upwardly forwardly inclined position when said portion engages said base when said platform means is in said rest position, whereby energization of said power means causes said actuating means to raise or lower said platform means and a chair attached thereto as desired.

18. Lifting apparatus as defined in claim 17, wherein the front end of said rear lever means abuts a lower surface of the rear end of said front lever means when said platform means is in said rest position.

19. Lifting apparatus as defined in claim 18, wherein the pivotal connection of the front end of the rear lever means to the base is rearwardly spaced from the pivotal connection of the front end of the front lever means to the base.

20. Lifting apparatus as defined in claim 17, said platform means including a flat mounting plate having a plurality of openings which enable various types of chairs to be mounted on said platform means.

21. Lifting apparatus which is adapted to be readily attachable under a chair which may be normally independently supported on a floor, said apparatus comprising a generally horizontal, rectangular base having a pair of laterally spaced side members and front and rear cross members extending between and connected to said side members, generally horizontal platform means adapted to support a chair attached thereto, first connecting means pivotally connecting said platform means to said side members to permit said platform means to move with respect to said base vertically from a generally horizontal rest position to a forwardly tilting raised position, said first connecting means comprising front lever means having a front end pivotally connected to a front portion of said base and a rear end pivotally connected to and terminating adjacent a front portion of said platform means, rear lever means having a front end pivotally connected to said base adjacent said front lever means and a rear end pivotally connected to a rearward portion of said platform means, said front lever means being shorter than said rear lever means and wherein the pivotal connection of the front end of the rear lever means to the base is rearwardly spaced from the pivotal connection of the front end of the front lever means to the base, said platform means having a portion thereof engaging said base when in said rest position so that said base, said platform means and said front and rear lever means are vertically compact and are adapted to add very little additional height to a chair attached thereto, reversible power means including a rotary screw and tubular actuating means mounted on said screw for forward and rearward movement longitudinally therealong, second connecting means pivotally connecting said power means to said rear cross member with said rotary screw extending forwardly from said rear cross member, third connecting means pivotally connecting said actuating means to said platform means, said rotary screw and actuating means being maintained in a slightly upwardly forwardly inclined position and said actuating means being positioned rearwardly on said rotary screw when said platform means is in said rest position, whereby said power means may be energized to move said actuating means forwardly along said rotary screw to raise said platform means from said rest position.

22. Lifting apparatus as defined in claim 21, wherein the front end of said rear lever means lies underneath the rear end of said front lever means when said platform means is in said rest position.

23. Lifting apparatus as defined in claim 21, said platform means including a flat mounting plate having a plurality of openings which enable various types of chairs to be mounted on said platform means.

* * * * *